US010507684B2

(12) United States Patent
Nakajima et al.

(10) Patent No.: US 10,507,684 B2
(45) Date of Patent: Dec. 17, 2019

(54) WRITING INSTRUMENT

(71) Applicant: MITSUBISHI PENCIL COMPANY, LIMITED, Tokyo (JP)

(72) Inventors: Tooru Nakajima, Yokohama (JP); Yusuke Kobayashi, Yokohama (JP); Kensuke Inoue, Yokohama (JP); Kazuhiko Furukawa, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/061,881

(22) PCT Filed: Dec. 28, 2016

(86) PCT No.: PCT/JP2016/089092

§ 371 (c)(1),
(2) Date: Jun. 13, 2018

(87) PCT Pub. No.: WO2017/115843

PCT Pub. Date: Jul. 6, 2017

(65) Prior Publication Data

US 2018/0370274 A1 Dec. 27, 2018

(30) Foreign Application Priority Data

Dec. 28, 2015 (JP) ..... 2015-257205

(51) Int. Cl.
*B43K 8/06* (2006.01)
*B43K 8/02* (2006.01)
(Continued)

(52) U.S. Cl.
CPC ..... *B43K 8/024* (2013.01); *B43K 1/12* (2013.01); *B43K 3/00* (2013.01); *B43K 8/02* (2013.01);
(Continued)

(58) Field of Classification Search
CPC ..... B43K 8/04; B43K 8/024; B43K 8/026; B43K 8/03; B43K 8/08; B43K 8/12; B43K 8/02; B43K 8/022; B43K 8/06
(Continued)

(56) References Cited

U.S. PATENT DOCUMENTS 9,545,813 B2 * 1/2017 Fukumoto ..... B43K 1/08
9,981,499 B2 * 5/2018 Fukumoto ..... B43K 7/00
(Continued)

FOREIGN PATENT DOCUMENTS

| | | | |
|---|---|---|---|
| EP | 1 266 770 | A1 | 12/2002 |
| JP | 8-290696 | A | 11/1996 |
| JP | 2005-131943 | A | 5/2005 |
| JP | 2013-252654 | A | 12/2013 |
| JP | 2013-252655 | A | 12/2013 |

OTHER PUBLICATIONS

International Search Report dated Feb. 28, 2017, issued in counterpart application No. PCT/JP2016/089092. (1 page).
(Continued)

*Primary Examiner* — Jennifer C Chiang
(74) *Attorney, Agent, or Firm* — Westerman, Hattori, Daniels & Adrian, LLP

(57) ABSTRACT

A writing implement is provided which is designed to draw lines using capillary action, wherein the width of the line can be freely adjusted while the line is being drawn and it is possible to draw lines of almost the same width at the beginning of the use of the writing implement as at the end of use. A felt-tip pen 1 is provided with an ink reservoir 11, a collector 17, and a core 29 for drawing by capillary action the ink that has been dispensed by the collector 17, dispensing the drawn ink from the tip, and adhering same to a paper surface. Even in repetitive writing, the rate of variability in the width of the lines drawn at the end of use with respect to the width of lines drawn at the beginning of use is 10% or less.

7 Claims, 7 Drawing Sheets

(51) Int. Cl.

| | |
|---|---|
| ***B43K 8/08*** | (2006.01) |
| ***B43K 1/12*** | (2006.01) |
| ***B43K 8/12*** | (2006.01) |
| ***B43K 3/00*** | (2006.01) |
| ***B43K 8/03*** | (2006.01) |

(52) U.S. Cl.
CPC ..... *B43K 8/022* (2013.01); *B43K 8/026* (2013.01); *B43K 8/03* (2013.01); *B43K 8/06* (2013.01); *B43K 8/08* (2013.01); *B43K 8/12* (2013.01)

(58) Field of Classification Search
USPC ..... 401/198
See application file for complete search history.

(56) References Cited

U.S. PATENT DOCUMENTS

| | | | | |
|---|---|---|---|---|
| 10,336,129 | B2 * | 7/2019 | Nakajima | B43K 8/02 |
| 2002/0081142 | A1 | 6/2002 | Koyama et al. | |
| 2015/0165812 | A1 | 6/2015 | Fukumoto et al. | |
| 2015/0202912 | A1 | 7/2015 | Niwa | |

OTHER PUBLICATIONS

Written Opinion dated Feb. 28, 2017, issued in counterpart application No. PCT/JP2016/089092. (4 pages).
Extended (Supplementary) European Search Report dated Jul. 1, 2019, issued in counterpart EP application No. 16881817.7 (9 pages).

* cited by examiner

FIG.4 ( a )
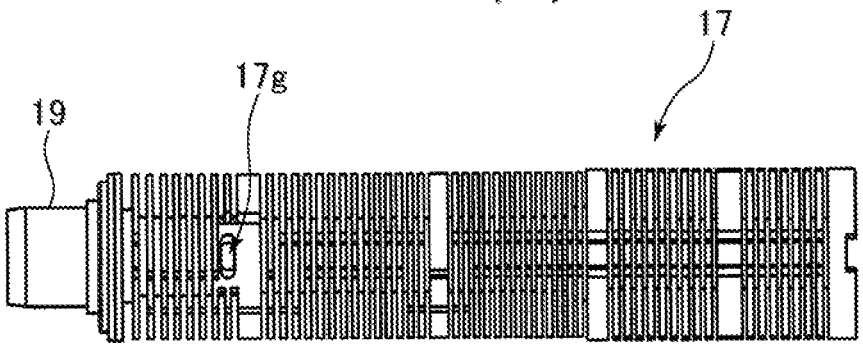
FIG.4 ( b )
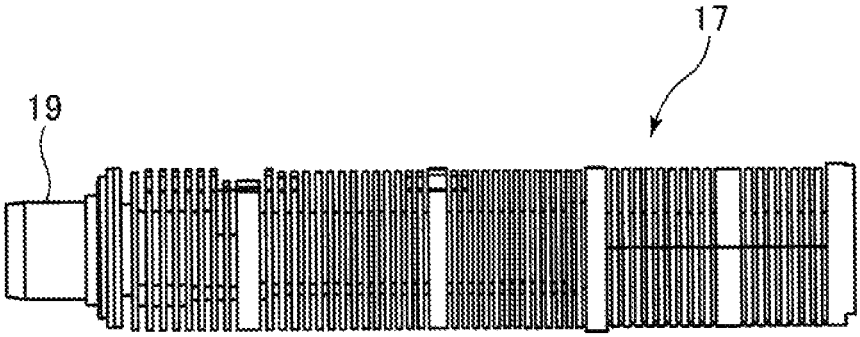
FIG.4 ( c )
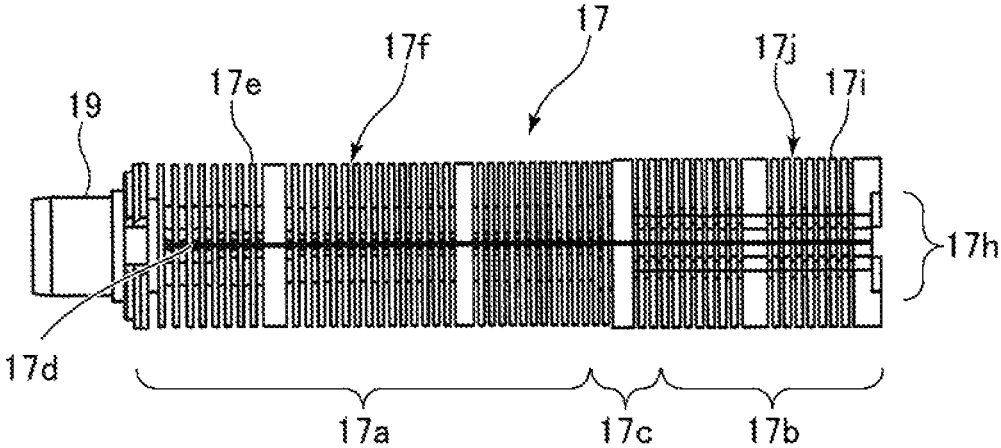

FIG.5 ( a )
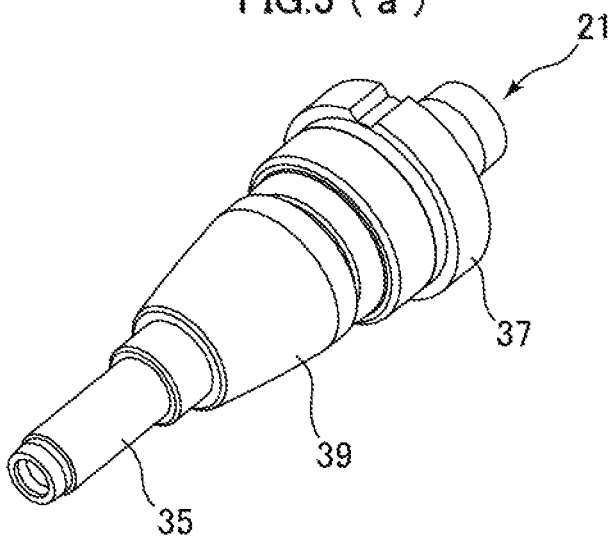
FIG.5 ( b )
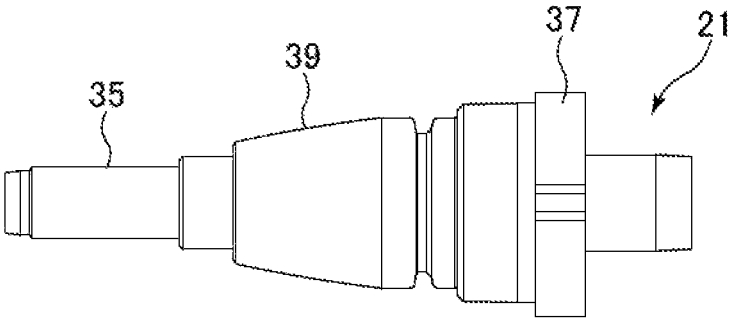
FIG.5 ( c )
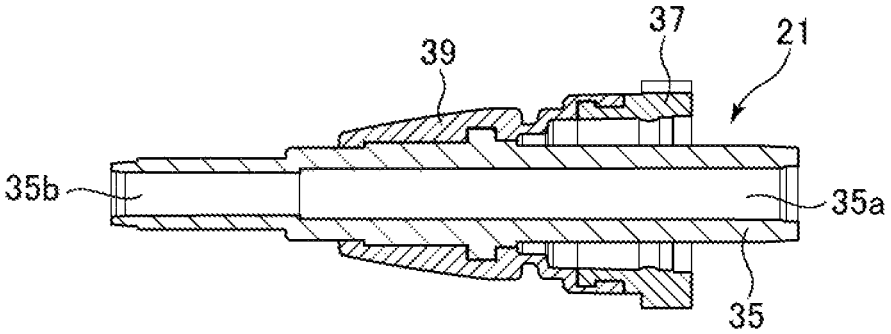

FIG.6 ( a )
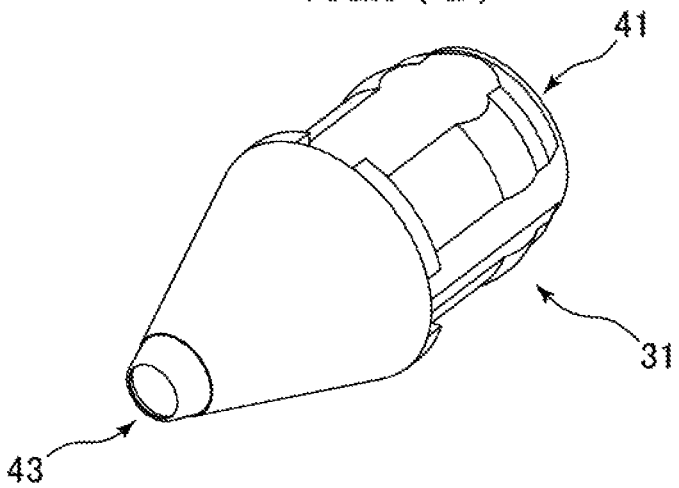
FIG.6 ( b )
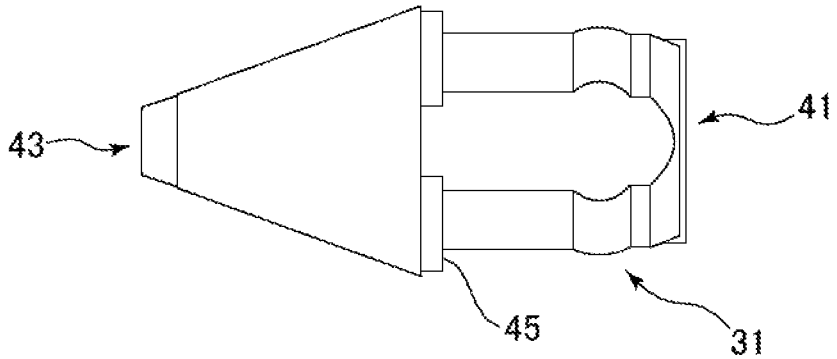
FIG.6 ( c )
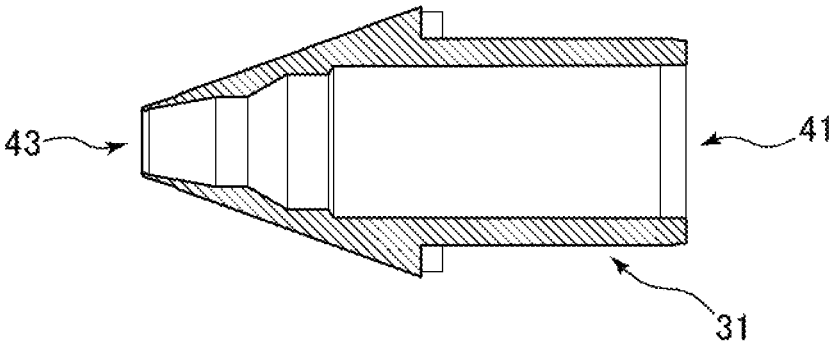

WRITING INSTRUMENT

TECHNICAL FIELD

The present invention relates to a writing instrument, and more particularly to a writing instrument which can draw a line using a capillary force, such as a felt-tip pen or a marking pen.

BACKGROUND ART

Conventionally, a ballpoint pen which is capable of changing a width of a drawn line is known (for instance, Patent Literatures 1 and 2).

CITATION LIST

Patent Literature

Patent Literature 1: Japanese Patent Laid-Open No. 2013-252654

Patent Literature 2: Japanese Patent Laid-Open No. 2013-252655

SUMMARY OF INVENTION

Technical Problem

However, the writing instrument described in Patent Literatures 1 and 2 relate to a ballpoint pen. In addition, in a ballpoint pen, due to its structure, there is a limit to the thickness of a line that can be drawn, and a writing instrument is desired which can change the width of a line while drawing a relatively thick line.

In addition, in a writing instrument which draws the line using a capillary force such as a felt-tip pen or a marking pen, in general, a difference of line width occurs between the start of the use of the writing instrument and the end of the use thereof.

Then, an object of the present invention is to provide a writing instrument that can draw a line by using a capillary force, and can freely adjust a width of a line while drawing the line, and can draw lines of which the widths are approximately equal between the start of the use of the writing instrument and the end of the use thereof.

Solution to Problem

In order to solve the above described problems, the present invention provides a writing instrument that includes: an ink storage part which stores ink; an air replacement mechanism which sends ink from the ink storage part by sending air into the ink storage part; and a central core which sucks the ink sent out by the air replacement mechanism with a capillary force, sends the sucked ink from a tip, and makes the ink adhere to a paper surface, wherein a rate of change is 10% or smaller between the widths of lines before writing and after writing when the lines are written alternately and repeatedly with a writing weight of 50 g and a writing weight of 200 g.

In the thus configured present invention, it is preferable for a ratio of a width of a line drawn on the writing conditions of the writing angle of 60 degrees and the writing weight of 200 g, to a width of a line drawn on the writing conditions of the writing angle of 90 degrees and the writing weight of 50 g to be 1.5 or larger, and is more preferably to be 2.0.

In addition, in the thus configured present invention, it is preferable for the elastic limit point of a writing part including the central core to be 7.0 N or more, and is more preferable to be 9.8 N or more. By setting the elastic limit point at 7.0 N or more, it is possible to prevent the writing part from being damaged even when a person, who applies a force to the writing part at the time of writing, used.

In addition, in the thus configured present invention, it is preferable for a buckling strength of the writing part including the central core to be 7.0 N or more, and is more preferable to be 9.8 N or more. By setting the buckling strength at 7.0 N or more, it is possible to prevent the writing part from being damaged even when a person, who applies a force to the writing part at the time of writing, used.

In the thus configured present invention, it is preferable that the abrasion loss of the writing part 13 after a line of 100 m long is drawn is 0.3 mm or less. Because the abrasion loss of writing is 0.3 mm or less, it is possible to comfortably continue writing until the ink runs out even when a written distance is long.

In the thus configured present invention, it is preferable that a writing flow rate per unit area is 5 $g/m^2$ or more. By setting the writing flow rate per unit area at 5 $g/m^2$ or more, it is possible to prevent the phenomenon of a patchy line, in which the color of the written line becomes thin or broken at the time of writing.

In addition, it is preferable that the set load applied to the writing part when the writing part including the central core starts to relatively retract relative to a shaft tube due to the pressurization is 0.1 N or more and 7.0 N or less.

The cushioning force means a vertical load applied to the writing part when the writing part starts to relatively retract relative to the shaft tube by being compressed or pressurized in the axial direction at the time of writing.

By setting the cushioning force at 0.1 N or more and 7.0 N or less, it is possible to prevent the writing part from being bent or collapsed even when a large writing load is applied to the writing part.

Advantageous Effect of Invention

As described above, according to the present invention, the writing instrument can freely adjust the width of a line while drawing the line, and can draw a line of which the width is approximately equal between the start of use and the end of use.

BRIEF DESCRIPTION OF DRAWINGS

FIGS. 4(*a*) to 4(*c*) are views showing a collector, and FIGS. 4(*a*) to 4(*c*) show views of the collector, which have been viewed from three directions.

FIG. 5 is a view FIGS. 5(*a*) to 5(*c*) are views showing a joint; and specifically. FIGS. 5(*a*) to 5(*c*) show a perspective view, a side view and a cross-sectional view of the joint.

FIGS. 6(*a*) to 6(*c*) are views showing an outer member; and specifically, FIGS. 6(*a*) to 6(*c*) show a perspective view, a side view and a cross-sectional view of the outer member.

DESCRIPTION OF EMBODIMENT

A felt-tip pen according to an embodiment of the present invention will be described below with reference to the drawings. Incidentally, in the present specification, the term "front part" of the felt-tip pen and its components means a side on which the central core is provided in the axial direction of the felt-tip pen, and the term "rear part" means the opposite side to the front side.

Figure 1:
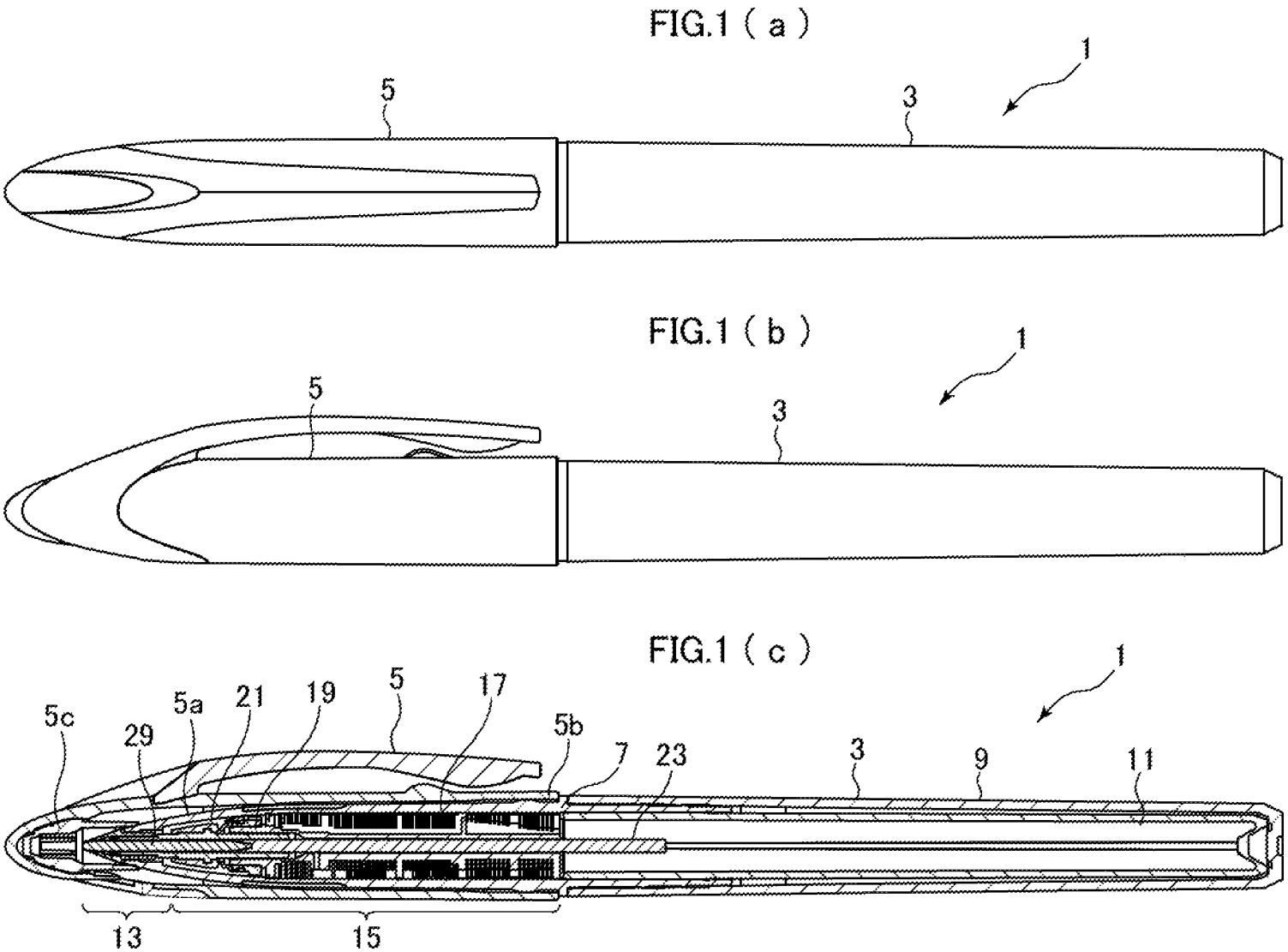
FIGS. 1(*a*) to 1(*c*) show a felt-tip pen according to an embodiment of the present invention; and more specifically, FIG. 1(*a*) and FIG. 1(*b*) show a state in which the front part of the felt-tip pen is covered with a cap, and FIG. 1(*e*) shows a cross-sectional view of the state of FIG. 1(*b*).
Figure 2:
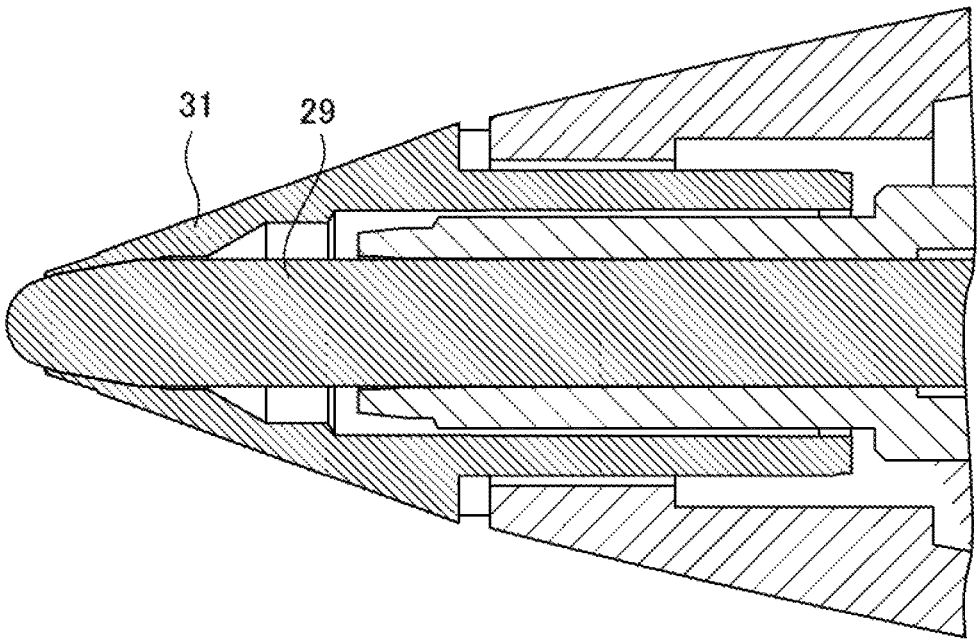
FIG. 2 is an enlarged view of a main part of FIG. 1(*c*).

FIGS. 1(*a*) to 1(*c*) show a felt-tip pen according t an embodiment of the present invention, and more specifically; FIG. 1(*a*) and FIG. 1(*b*) show a state in which the front part of the felt-tip pen is covered with a cap, and FIG. 1(*c*) shows a cross-sectional view of the state of FIG. 1(*b*). FIG. 2 shows an enlarged view of a main part of FIG. 1(*c*).

As is shown in FIG. 1 to FIG. 2, a felt-tip pen 1 has a main body 3 of the felt-tip pen and a cap 5 which is attached to the main body 3.

The main body 3 of the felt-tip pen has a generally tubular shape so that a user can grasp at the time of use, and has a front side shaft tube 7 and a rear side shaft tube 9. Threads are provided on the rear end portion of the front side shaft tube 7 and the front end portion of the rear side shaft tube 9, respectively, and by both of the threads being engaged with each other, the front side shaft tube 7 and the rear side shaft tube 9 are fixed to each other. In addition, by the front side shaft tube 7 and the rear side shaft tube 9 which have been engaged with and fixed to each other, a space is formed inside which receives each component for writing with the felt-tip pen. In addition, a fixing method by press fitting may be used for fixing the front side shaft tube 7 and the rear side shaft tube 9, instead of threaded engagement. In this case, in order to prevent an outer member 31 from being damaged by the impact at the time of assembly, the press fitting force is desirably set at 300 N or smaller. Incidentally, in the following, the space formed in the inside of the front side shaft tube 7 and the rear side shaft tube 9 will be simply referred to as "internal space", for explanation in detail.

The cap 5 is structured so as to be capable of being attached to and detached from the front side of the main body 3 of the felt-tip pen, and seals the tip of the felt-tip pen thereby to prevent the ink from drying up. The cap 5 has an inner cap 5*c* and a fitting portion 5*b*. The inner cap 5*c* is structured so as to fit over the main body 3 so as to completely seal the outer member 31 and the central core 29 of the felt-tip pen, which will be described below. In addition, the cap 5 itself is detachably attached to the main body 3 with a predetermined fitting force, for instance, a fitting force of 60 N or smaller, through the fitting portion 5*b*. By the fitting force of the cap 5 being set at 60 N or smaller, the outer member 31 can be prevented from being damaged by the impact at the time when the cap 5 is attached.

In the rear side of the internal space, an ink storage part 11 for storing ink therein is arranged; in the front side of the internal space, a writing part 13 for writing with the ink in the ink storage part 11 is arranged; and further, an ink supply part 15 for supplying the ink in the ink storage part 11 to the writing part 13 is provided in between the ink storage part 11 and the writing part 13.

The ink storage part 11 stores a predetermined ink therein, and is structured so as to be capable of appropriately supplying the ink to the writing part 13 by a capillary force, when the amount of ink in the writing part 13 has become insufficient.

Any of pigments and dyes may be used as a coloring material, for the ink which is stored in the ink storage part 11. There is no particular restriction on the type of the pigment, and any arbitrary type can be used from inorganic and organic pigments which are conventionally used for writing instruments such as a water base ballpoint pen.

Examples of the inorganic pigments include carbon black and metal powder etc. In addition, examples of the organic pigments include azo lake, insoluble azo pigments, chelate azo pigments, phthalocyanine pigments, perylene and perinone pigments, anthraquinone pigments, quinacridone pigments, dye lake, nitro pigments and nitroso pigments. Specifically, usable examples include Phthalocyanine Blue (C. I. 74160), Phthalocyanine Green (C. I. 74260), Hansa Yellow 3G (C. I. 11670), Disazo Yellow GR (C. I. 21100), Permanent Red 4R (C. I. 12335), Brilliant Carmine 6B (C. I. 15850) and Quinacridone Red (C. I. 46500).

In addition, plastic pigments which are composed of particles of a styrenic or acrylic resin may also be used. Furthermore, hollow resin particles having voids inside the particles can be used as a white pigment, or a pigment that is also referred to as a pseudo pigment which is a resin particle dyed with dye can be also used. Specific product names of the pseudo pigments include Sinloihi color SF series (Sinloihi Co., Ltd.), and NKW and NKP series (Nippon Keiko Kagaku Co., Ltd.).

Any one of a direct dye, an acidic dye, an edible dye and a basic dye can be used as a water-soluble dyestuff. Examples of the direct dyes include: C. I. Direct Black 17, Direct Black 19, Direct Black 22, Direct Black 32, Direct Black 38, Direct Black 51 and Direct Black 71; C. I. Direct Yellow 4, Direct Yellow 26, Direct Yellow 44 and Direct Yellow 50; C. I. Direct Red 1, Direct Red 4, Direct Red 23, Direct Red 31, Direct Red 37, Direct Red 39, Direct Red 75, Direct Red 80, Direct Red 81, Direct Red 83, Direct Red 225, Direct Red 226 and Direct Red 227; and C. I. Direct Blue 1, Direct Blue 15, Direct Blue 71, Direct Blue 86, Direct Blue 106 and Direct Blue 119 and so on.

Examples of the acid dyes include: C. I. Acid Black 1, Acid Black 2, Acid Black 24, Acid Black 26, Acid Black 31, Acid Black 52, Acid Black 107, Acid Black 109, Acid Black 110, Acid Black 119 and Acid Black 154; C. I. Acid Yellow 7, Acid Yellow 17, Acid Yellow 19, Acid Yellow 23, Acid Yellow 25, Acid Yellow 29, Acid Yellow 38, Acid Yellow 42, Acid Yellow 49, Acid Yellow 61, Acid Yellow 72, Acid Yellow 78, Acid Yellow 110, Acid Yellow 127, Acid Yellow 135, Acid Yellow 141 and Acid Yellow 142; C. I. Acid Red 8, Acid Red 9, Acid Red 14, Acid Red 18, Acid Red 26, Acid Red 27, Acid Red 35, Acid Red 37, Acid Red 51, Acid Red 52, Acid Red 57, Acid Red 82, Acid Red 87, Acid Red 92, Acid Red 94, Acid Red 115, Acid Red 129, Acid Red 131, Acid Red 186, Acid Red 249, Acid Red 254, Acid Red 265 and Acid Red 276; C. I. Acid Violet 18 and Acid Violet 17; C. I. Acid Blue 1, Acid Blue 7, Acid Blue 9, Acid Blue 22, Acid Blue 23, Acid Blue 25, Acid Blue 40, Acid Blue 41, Acid Blue 43, Acid Blue 62, Acid Blue 78, Acid Blue 83, Acid Blue 90, Acid Blue 93, Acid Blue 103, Acid Blue 112, Acid Blue 113 and Acid Blue 158; and C. I. Acid Green 3, Acid Green 9, Acid Green 16, Acid Green 25 and Acid Green 27 and so on.

Most of edible dyes are included in the direct dye or the acidic dye, but one example of the dyes which are not included therein includes C. I. Food Yellow 3.

Examples of the basic dyes include: C. I. Basic Yellow 1, Basic Yellow 2 and Basic Yellow 21; C. I. Basic Orange 2, Basic Orange 14 and Basic Orange 32; C. I. Basic Red 1, Basic Red 2, Basic Red 9 and Basic Red 14; C. I. Basic Brown 12; and Basic Black 2 and Basic Black 8 and so on.

These coloring agents may be used each solely or in combination with one or more other coloring agents, and the content of the coloring agents in the ink is usually in a range of a weight ratio of 0.5 to 30%, and is preferably in a range of a weight ratio of 1 to 15%.

If the content of the coloring agent is less than 0.5%, the coloring power is insufficient, which is not preferable. On the other hand, when the content of the coloring agent exceeds 30%, a writing failure may occur, which is accordingly not preferable.

When the dyes are used, the ink which has adhered to the writing part 13 tends to remain thereon as stain, and accordingly it is preferable to use the pigments.

Furthermore, in order to prevent the writing failure due to drying and solidification of the ink at the pen tip, it is preferable to set the content of the water-soluble solvent in the ink, at a weight ratio of 1% to 25%. In this case, examples of water-soluble solvents include glycols such as ethylene glycol, diethylene glycol, triethylene glycol, propylene glycol, polyethylene glycol, 3-butylene glycol, thiodiethylene glycol and glycerin; ethylene glycol monomethyl ether and diethylene glycol monomethyl ether etc.; and can be used alone or by mixture.

In addition, it is preferable to blend at least one selected from among the trimethylolpropane, the trimethylol ethane and the neopentyl glycol which are water-soluble solvents other than the above described solvents, in the ink, in a weight ratio of 0.1 to 5% with respect to the ink.

Generally, if the amount of the water-soluble solvent to be blended increases, the permeability of the ink to paper decreases, and accordingly the drying speed of the drawn line becomes slow. However, trimethylolpropane, trimethylol ethane and neopentyl glycol have few such properties of lowering the permeability, and they do not easily cause lowering of the drying speed of the drawn line. On the other hand, the above substances have the properties of preventing the drying and the solidification at the pen tip, and accordingly a writing failure does not easily occur even when the pen tip is exposed for a long time.

The ink can be blended with saccharides. Examples of the saccharides specifically include monosaccharides, disaccharides, oligosaccharides, reducing saccharides, non-reducing saccharides, sugar alcohols, decomposed products of reduced starch, and mixtures thereof. It is preferable to use non-reducing saccharides out of the above saccharides, and is particularly preferable to use the sugar alcohols. Saccharides having reducing properties occasionally cause a discoloration of the ink or cause a fluctuation of the pH.

The non-reducing saccharides are not particularly limited as long as the non-reducing saccharides are saccharides which do not exhibit reducing properties, and examples of the non-reducing saccharides include sucrose, trehalose and sugar alcohols. Reducing saccharides such as glucose (grape sugar) are saccharides which exhibit weak reducing properties by having a carbonyl group (reducing group) such as an aldehyde group and a ketone group in the molecule; but on the other hand, the non-reducing saccharides to be used in the present embodiment do not exhibit the reducing properties because the group having reducing properties of the monosaccharide is bonded to another saccharide through a glycosidic bond or the like.

The sugar alcohol is a generic term of chain polyhydric alcohol obtained by the reduction (hydrogenation) of a carbonyl group which saccharides have. Examples of the sugar alcohols include "sorbitol" obtained by the reduction of glucose, "maltitol" obtained by the reduction of maltose, decomposed products of reduced starch (reduced starch syrup) which are obtained by the reduction of starch syrup and dextrin that have different degrees of saccharification, reduced dextrin, erythritol and pentaerythritol; and commercially available products can be used as the sugar alcohols.

It is desirable to use at least one type selected from sorbitol, erythritol, pentaerythritol, trehalose, and decomposed products of reduced starch, among the above non-reducing saccharides, from the viewpoint of further imparting temporal stability.

The saccharides work as a moisturizing agent in the ink, but on the other hand, have also such properties as to form a film and be solidified easily. In the present embodiment, if an ink remaining in the writing part 13 forms a film and is solidified, such a phenomenon occurs that the ink does not flow out (initial writing property is poor) when the next writing starts. In order to avoid such a problem, it is preferable that the saccharides contained in the ink have a degree of polymerization in between monosaccharide and 20 saccharide, and is further preferable that an average degree of polymerization is 3 to 10. Thereby, it is possible to prevent the film strength from becoming excessively strong, and it is possible to secure the initial writing property even in the case where the ink has remained in the writing part 13.

As a moisturizing agent other than the above described saccharides, urea, ethylene urea, tetramethyl urea, thiourea, ethylene oxide adduct to the urea, trimethylglycine, pyrophosphate and pyrrolidones can be blended. These moisturizing agents can be blended in combination with the above described saccharides.

The ink can be blended with a penetrating agent. The penetrating agent is used mainly for the purpose of improving the drying properties of the drawn line by promoting the permeability of the ink into the paper. The penetrating agent is preferably a surface active agent, and a nonionic or anionic surface active agent is preferable. Specifically, polyglycerol fatty acid ester, polyoxyethylene sorbitan fatty acid ester, polyethylene glycol fatty acid ester, polyoxyethylene alkyl ether, polyoxyethylene alkyl phenyl ether, salts of dialkyl or dialkenyl sulfosuccinic acid, phosphoric acid esters, fluorine compounds can be blended.

In addition, as for the characteristics of the ink, it is preferable to select such an ink that the contact angle of the ink becomes 70 degrees or smaller after 20 seconds in relation to the outer member of the writing part 13, which will be described below. When the contact angle exceeds 70 degrees, the expandability of the ink with respect to the outer member becomes insufficient, and accordingly the responsiveness at the time when the second writing part works decreases, and the drawn line becomes patchy. Incidentally, the contact angle is measured by dropping ink onto a plate-shaped test piece which is formed of the same material as the outer member, in an environment of 25° C. and 65% RH.

Furthermore, it is preferable to use an ink of which the surface tension is 48 mN/m or less. If the surface tension exceeds 48 mN/m, the expandability of the ink with respect to the outer member becomes insufficient, and accordingly the responsiveness at the time when the second writing part works decreases, which tends to easily cause a phenomenon similar to the above description.

In addition, it is preferable to set the contents of insoluble components such as pigment and resin particles contained in the ink, at 20 wt % or less. If the insoluble component exceeds 20 wt %, the flowability of the ink decreases, and accordingly the expandability of the ink with respect to the outer member tends to become insufficient. Furthermore, the ink which has adhered to the outer member becomes easily dried and solidified, which tends to easily cause the writing failure.

Furthermore, it is preferable that the average particle diameter of the insoluble component contained in the ink is 200 nm or less. If the average particle diameter exceeds 200 nm, the flowability of the ink decreases, and accordingly the expandability of the ink with respect to the outer member tends to become insufficient.

The ink supply part 15 has an approximately tubular collector 17, which has a plurality of fins formed on its circumference. The collector 17 is structured so as to send out the ink in the ink storage part 11 from the ink storage part 11, by replacing the ink in the ink storage part 11 with the air sucked from the outside. A tip of the collector 17 is formed so as to have a reduced diameter to form a tip holding part 19. The rear end portion of the collector 17 comes in contact with the front end portion of the ink storage part 11. The tip holding part 19 of the collector 17 is fitted into the inside of a joint 21 from the rear end portion of the joint.

Figure 3:
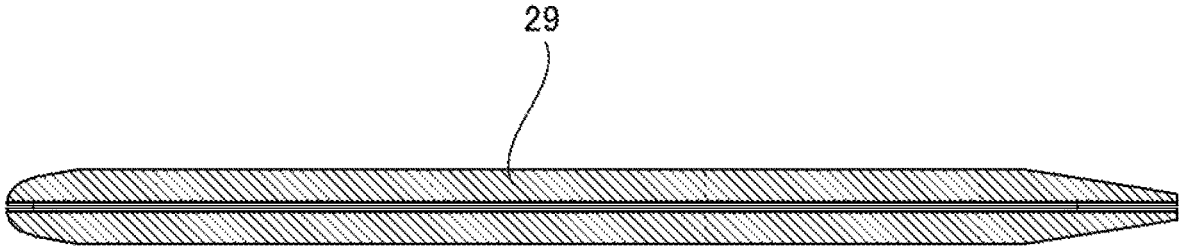
FIG. 3 is a longitudinal cross-sectional view of a central core.

FIG. 3 is a longitudinal cross-sectional view of the central core. The central core 29 is formed by extrusion-molding of a resin material such as polyacetal. A passage for guiding the ink in the ink storage part 11 toward the front end side therethrough by a capillary phenomenon is formed in the central core 29. It is preferable for the elastic limit point of the writing part 13 including such a central core 29 to be 7.0 N or more. In addition, it is preferable for the buckling strength when a load is applied to the writing part 13 in the longitudinal direction to be 7.0 N or more. By setting the elastic limit point and/or the buckling strength of the writing part 13 at 7.0 N, it is possible to continue writing without causing the deformation of the writing part 13, even when a person with a strong writing pressure writes. In addition, it is preferable that the abrasion loss of the writing part 13 is 0.3 mm or less when a line of 100 m long is written under writing conditions of a writing angle of 65 degrees, a writing weight of 50 g and a writing speed of 4.2 m/min. In addition, it is also possible to change the elastic limit point, the buckling strength and the abrasion loss, depending on the porosity of the material of the central core, the shape of the passage and the like.

FIGS. 4(*a*) to 4(*c*) are views showing a collector, and FIGS. 4(*a*) to 4(*c*) show views of the collector, which have been viewed from three directions. As is shown in FIGS. 4(*a*) to 4(*c*), the collector 17 has a front side storage part 17*a*, a rear side dummy part 17*b*, and a partition part 17*c* in between the storage part 17*a* and the dummy part 17*b*.

On the circumference of the storage part 17*a*, there are provided an ink guide groove 17*d* which extends along the axis of the storage part 17*a* and has a predetermined width along the circumferential direction, and main part temporary ink storage grooves 17*f*, which are formed in between a plurality of fins 17*e*. Furthermore, in the storage part 17*a*, a hole 17*g* is provided which makes the circumference of the storage part 17*a* communicate with the inner space and extends therebetween.

The ink guide groove 17*d* is formed by the plurality of fins 17*e* being notched into the same shape, which have been arrayed in the axial direction, forms a groove having a predetermined shape, which is recessed from the circumference of the storage part 17*a* when the storage part 17*a* is viewed in the axial direction. The ink guide groove 17*d* communicates with the main part temporary ink storage groove 17*f*. The width of the ink guide groove 17*d* is formed so as to be narrower than the width of the main part temporary ink storage groove 17*f*. Thus, due to the width of the ink guide groove 17*d* being made narrower than the width of the main part temporary ink storage groove 17*f*, the interfacial tension with the ink in the ink guide groove 17*d* becomes stronger than the interfacial tension with the ink in the main part temporary ink storage groove 17*f*. Because of this, while making the ink exist in the ink guide groove 17*d*, the ink guide groove 17*d* can surely make the ink flow into or flow out from the main part temporary ink storage groove 17*f* through itself.

Easiness of the flow of the ink at the time of writing depends on the width of the ink guide groove 17*d* and the distance between the fins 17*e*. Then, in the present embodiment, it is preferable to set the width of the ink guide groove 17*d* at 0.1 to 0.2 mm. As the width of the ink guide groove 17*d* is smaller, the capillary force of the collector 17 becomes easier to act; but on the other hand, when the width becomes 0.1 mm or less, which is too small, the supply of the ink from the collector 17 becomes unstable. The ink resists being discharged (flown out). In addition, the distance between the fins 17*e* is determined according to the width of the ink guide groove 17*d*, and is set to be larger than the width of the ink guide groove 17*d*, in a range of 0.1 to 0.6 mm. If the width between the fins 17*e* is larger than 0.6 mm, it becomes difficult to store the ink in the storage part 17*a*, and if the width between the fins 17*e* is smaller than 0.1 mm, the ink remains in the storage part 17*a*, and there is a possibility that the ink is not used up.

On the circumference of the dummy part 17*b*, there are provided an ink introduction groove 17*h* which extends in the axial direction, and extended part air grooves 17*j* which are formed each between a plurality of fins 17*i*. The dummy part 17*b* prevents the ink from flowing into the storage part 17*a* of the collector 17, when the cap 5 is opened downward. More specifically, when the cap 5 is opened downward, the space inside the tip, which has been sealed by the cap 5, is decompressed and thereby the ink tries to flow into the storage part 17*a* of the collector 17. By the dummy part 17*b* being provided on the rear side of the collector 17, the ink flows into spaces in between the circumferential fins 17*i* in the dummy part 17*b*, and the ink does not flow into the storage part 17*a* of the collector 17.

In addition, the hole 17*g* of the storage part 17 is a hole for preventing the collector 17 and the space in the ink storage part 11 from being pressurized when the writing part 13 is moved, and preventing the ink from spouting from the pen tip. More specifically, by forming the hole 17*g* which communicates the inside with the outside of the storage part 17, the ink is discharged to the outside through the hole 17*g* even though the collector 17 and the space in the ink storage part 11 have been pressurized when the writing part 13 has been moved, and accordingly it is possible to prevent the pressure in the collector 17 and the ink storage part 11 from increasing. It is preferable that the opening area of the hole 17*g* is 0.4 to 1.2 $mm^2$.

In addition, the collector 17 has a rod-like collector core 23 made of polyester fiber. The collector core 23 extends in the axial direction, the rear end portion is slidably arranged inside the ink storage part 11, and the front end portion extends beyond the joint 21. The collector core 23 is arranged so as to form a gap of 0.02 to 0.2 mm between the internal perimeter surface of the collector 17 and itself. Due to the gap of 0.02 to 0.2 mm being provided between the collector 17 and the collector core 23, it becomes possible to prevent a large amount of air from entering the gap at the time of writing, while securing slidability between the collector 17 and the collector core 23. In addition, the rear end of the collector core 23 extends to project beyond the rear end of the collector 17. In order to achieve both ink supply stability and ease of suction, it is preferable that the collector core 23 is formed from a material having a porosity of 30 to 60%, and is most preferable to have the porosity of 45%.

The joint 21 is a member for connecting the writing part 13 with the ink supply part 15. Incidentally, the structure of the joint 21 will be described below.

The writing part 13 has a central core 29, and an outer member 31 which covers the circumference of the central core 29.

FIGS. 5(*a*) to 5(*c*) are views showing a joint; and specifically, FIGS. 5(*a*) to 5(*c*) show a perspective view, a side view and a cross-sectional view of the joint. The joint 21 shown in FIGS. 5(*a*) to 5(*c*) has, a cylindrical tubular portion 35, an anchor portion 37 which is arranged outside the tubular portion 35, and a holding portion 39 which holds the tubular portion 35 on a base of the anchor portion 37.

The tubular portion 35 has such an internal shape as to be capable of fixing the collector core 23 and the central core 29 in its inside. Specifically, the internal diameter of the tubular portion 35 includes: a rear internal diameter portion 35*a* which receives and fixes a comparatively thick collector core 23, in the rear side thereof; and a front internal diameter portion 35*b* which receives and fixes a comparatively thin central core 29, in a more front side than the portion at which the collector core 23 is fixed. The fixing method may be a method of inserting the central core 29 and the collector core 23 into the tubular portion 35, and punching the portion to which the central core 29 and the collector core 23 are inserted, from the outside; a method of adjusting the external diameter of the central core 29 to be larger than the internal diameter of the front internal diameter portion 35*b*, and press fitting the central core 29; and other fixing methods. When sealability between the central core 29 and the front internal diameter portion 35*b* is needed, a press fitting method is preferable. In addition, in the case or the like where the strength of the central core 29 is weak and there is a concern that the central core 29 is collapsed at the time of assembling, it is preferable to fix the central core 29 by a punching operation which applies less force to the central core 29.

The anchor portion 37 has a ring shape of which the internal diameter is larger than an external diameter of the tubular portion 35, and is arranged on a further rear side than the middle in the longitudinal direction of the tubular portion 35. More specifically, the internal diameter of the anchor portion 37 is larger than the external diameter of the tubular portion 35, a space is formed between the anchor portion 37 and the tubular portion 35, and the tip holding part 19 is inserted into the space. When the tip holding part 19 is inserted into the space, the circumference of the tip holding part 19 is fitted into the inner circumference of the anchor portion 37, and the anchor portion 37 is fixed to the tip holding part 19. Incidentally, a space of a cylindrical shape is formed in the tip holding part 19, and the internal diameter of the space of the cylindrical shape is larger than the external diameter of the tubular portion 35, and is designed so that when the tip holding part 19 and the tubular portion 35 are arranged coaxially with each other, the tubular portion 35 and the tip holding part 19 do not come into contact with each other.

The holding portion 39 has a conical tubular shape which extends so as to taper from the circumference of the anchor portion 37 to the circumference of the tubular portion 35 toward the front side. In addition, the holding portion 39 is arranged between the anchor portion 37 which is fixed to the tip holding part 19 and the tubular portion 35 which is not fixed to the other members and suspends the tubular portion 35 with respect to the anchor portion 37; and thereby it becomes possible to suspend the tubular portion 35 and the central core 29 and the collector core 23 in the writing part 13, which are fixed to the tubular portion 35, so as to be movable in the axial direction with respect to the outer member 31 that is fixed to the front side shaft tube 7. Thereby, the pressure applied to the central core 29 can be absorbed at the time of writing.

The tubular portion 35 and the anchor portion 37 which constitute the joint 21 are formed from, for instance, a thermoplastic resin. In addition, the holding portion 39 is formed from, for instance, a thermoplastic elastomer. Specific examples thereof include styrene-based elastomers such as SBS, SEBS and SEPS, olefin-based elastomers, urethane-based elastomers, and polyester-based elastomers. Among the elastomers, elastomers having a durometer A hardness of 20 to 60 in accordance with ISO 7619 have a good balance between the writing pressure and a cushioning response. Furthermore, the cushioning properties of the joint 21 can be adjusted by adjusting the strength of the holding portion 39. In addition, the thermoplastic elastomer sensitively expands and contracts in response to the change of the load until just before the inflection point at which elastic deformation starts, and accordingly, it is possible to form a joint 21 which highly sensitively expands and contracts in response to the load at the time of writing and is excellent in cushioning properties, by adjusting, for instance, the thickness, the composition and the like of the holding portion 39 and setting the inflection point of the load with respect to the displacement amount at approximately 1 N. In addition, a certain degree of adhesion becomes necessary between the tubular portion 35 and the holding portion 39, in order to make both of the portions not come off from each other at the time of cushioning. In order to achieve this adhesion, it is preferable to form the tubular portion 35 and the holding portion 39 from the same type of resin material; and as for selectable combinations between the materials, there are a combination of AS (styrene-based resin) and SEBS (styrene-based elastomer), a combination of polypropylene (polyolefin-based resin) and EPDM (polyolefin-based elastomer), and a combination of PBT (polyester-based resin) and a polyester-based elastomer.

Among the combinations, the holding portion 39 preferably has a durometer A hardness in accordance with ISO 7619 of 20 to 60 degrees, and most preferably of 30 to 50 degrees. Due to the durometer A hardness of the holding portion 39 being set in this range, the joint 21 can properly work even for a low writing pressure and absorb the pressure applied to the central core 29.

In addition, it is suitable to set the cushioning force of the whole felt-tip pen to be in a range of 0.1 to 10 N, preferably to be in a range of 0.1 to 7 N, and more preferably to be in a range of 0.1 to 5 N, by using the above described joint 21. This is because if the cushioning force is set to be too low, the line is written while the outer member 31 always comes in contact with a writing surface such as a paper surface at the time of writing, and accordingly it is difficult to write a thin written line. On the other hand, if the cushioning force is set too high, it becomes impossible for the user to write with bringing the outer member 31 into contact with the paper surface, at the time of writing.

FIGS. 6(*a*) to 6(*c*) are views showing the outer member; and specifically, FIGS. 6(*a*) to 6(*c*) show a perspective view, a side view and a cross-sectional view of the outer member. The outer member 31 is a conical tube which is made from a synthetic resin and is formed in an approximately conical shape, and has such a tapered shape as to taper toward the front. It is preferable that, the outer member 31 is formed from a synthetic resin such as polyacetal or polybutylene terephthalate having a certain strength so as not to hinder the condition of the pen and writing feeling in writing with pushing. The outer member 31 can be formed from a general synthetic resin. Specific examples of the synthetic resins include polyethylene, polypropylene, polyvinyl chloride, polyvinylidene chloride, polystyrene, polyvinyl acetate, polyurethane, fluororesin, ABS resin, AS resin, PMMA resin, poly-amide, polyacetal, polycarbonate, modified polyphenylene ether, polyethylene terephthalate, polybutylene terephthalate, polyphenylene sulfide and poly-ether ether ketone. It is preferable that the outer member 31 is formed from polyacetal and polybutylene terephthalate among the above synthetic resins, which do not hinder the condition of the pen, in particular, writing feeling in the writing with pushing, in which friction in particular strongly works, and which show little wear due to the writing and have high durability. By giving a certain strength to the outer member 31, it becomes possible to improve the durability of the outer member 31. In addition, it is preferable to control the surface of the outer member 31 to become a smooth surface, which can thereby reduce the frictional resistance with the paper surface at the time of writing and can improve the writing feeling. The coefficient of friction between the paper surface and the outer member 31 at the time of writing is preferably 0.5 or less by a Heidon value, and is more preferably 0.25 or less. The Heidon value is measured with the use of a surface property measuring instrument (HEIDON-14D made by Shinto Scientific Co., Ltd.). As for the measurement conditions, on conditions of a load of 100 g, a writing angle of 60 degrees and a writing speed of 6.25 cm/sec, the outer member 31 is linearly operated in an acute angle direction by 10 cm with respect to a writing paper which conforms to the old JIS (Japanese Industrial Standards) P3201 (high grade paper of which the sheet has been made from a raw material of 100% chemical pulp, having basis weight range of 40 to 157 g/m$^2$, and having whiteness degree of 75.0% or more).

In addition, the outer member 31 has a rear insertion hole 41 which is formed in the rear side, and a front insertion hole 43 which communicates with the tip side from the rear insertion hole 41 and has a diameter smaller than that of the rear insertion hole 41. A front end of the joint 21 is inserted into the rear insertion hole 41, and the holder 27 which is fixed to the front end of the joint 21 projects from the front insertion hole 43. At the time of assembly, the outer member 31 is fixed to the front end of the front side shaft tube 7 in such a state that the central core 29 is inserted into the front insertion hole 43 and the front end of the joint 21 is inserted into the rear insertion hole 41. Thereby, the central core 29 in the outer member 31 is held by the joint 21 so as to be movable in the axial direction in the outer member 31. It is preferable to set the thickness of the tip of the outer member 31, particularly in the vicinity of the front insertion hole 43, at 0.02 to 0.2 mm. Due to the thickness of the tip of the outer member 31 being set in this range, it becomes possible to secure the dischargeability of the ink at the time of writing while keeping durability.

In addition, the outer member 31 has a ring-shaped step 45 in a middle portion in the axial direction thereof, and the further rear side than the step 45 has an external diameter smaller than the internal diameter of the tubular space at the tip of the front side shaft tube 7, and the rear side of the outer member 31 is structured so as to be capable of being fitted into the front side shaft tube 7.

Hereinafter, the main functions/effects of the present embodiment will be summarized.

In the present embodiment, a width of the drawn line can be adjusted according to the writing weight. More specifically, when the writing weight is controlled small, the ink in the ink storage part 11 reaches the central core 29 of the writing part 13 through the collector 17 and the collector core 23 in the ink supply part 15. At this time, the central core 29 does not retract backward, accordingly the outer member does not touch the paper surface, and only the central core 29 comes in contact with the paper surface; and accordingly, the user can draw a relatively thin line. On the other hand, in the case where the writing weight has been controlled large, the central core 29 retracts backward, both the central core 29 and the outer member 31 come into contact with the paper surface, thereby a capillary force acts in the gap between the central core 29 and the outer member 31, and the user can draw a comparatively thick line.

In addition, in the present embodiment, the ink flow-out part at the tip resists collapsing, and accordingly the rate of change between the widths of the drawn lines at the start of use and at the end of use is small. More specifically, when a certain amount of load is applied to the central core 29 which is the ink flow-out part at the tip, the central core 29 retracts, the outer member 31 receives the writing pressure, and accordingly the central core 29 resists collapsing. In addition, the writing instrument can write a thick line due to the outer member 31, and accordingly can use a thin core having a relatively high strength for the central core 29. Due to these effects, even in repeated writing, the rate of change of the width of the line drawn at the end of use to the width of the line drawn at the start of use can be controlled, to 20% or smaller, and more preferably to 10% or smaller.

In addition, the writing instrument can receive the force applied to the central core 29 from the paper surface at the time of writing, by the outer member 31. More specifically, when the user writes a line with a strong writing pressure at which the abrasion loss at the writing part increases, the central core 29 retracts, and the writing instrument can alleviate the writing pressure; and furthermore, by reason that the central core 29 retracts and the outer member 31 also touches the paper surface, it becomes possible that the writing instrument receives the writing pressure on the outer member 31. Thereby, the writing instrument can suppress the wear of the writing part 13.

In addition, even if an excessive load is applied to the writing part 13, the writing instrument can receive the load by the outer member 31. More specifically, even if such an excessive load as to accidentally hit the writing part 13 is applied to the writing part 13, the outer member 31 protects the circumferential part of the central core 29 of the ink flow-out part, and accordingly the load is not applied to the central core 29. Thereby, the writing instrument can suppress the deformation of the writing part 13.

In addition, in the present embodiment, by adopting the joint 21 having high cushioning properties, the felt-tip pen can discharge a sufficient amount of ink even when the writing weight is light. Thereby, even in the case where a user whose writing weight is light has used the felt-tip pen, the felt-tip pen can avoid "discontinuity of ink at the time of writing" due to the shortage of the ink. This function/effect is observed particularly at the time of writing with pushing during which "discontinuity of ink at the time of writing" tends to easily occur.

In addition, according to the present embodiment, the amount of the ink which flows out can be accurately controlled by appropriately selecting the components of the ink and adjusting the surface tension and the flowability of the ink, and further it can properly prevent the outer member 31 of the writing part 13 from being stained by the ink. Furthermore, the writing starting properties of the felt-tip pen can be improved by adjusting the components of the ink.

Figure 7:
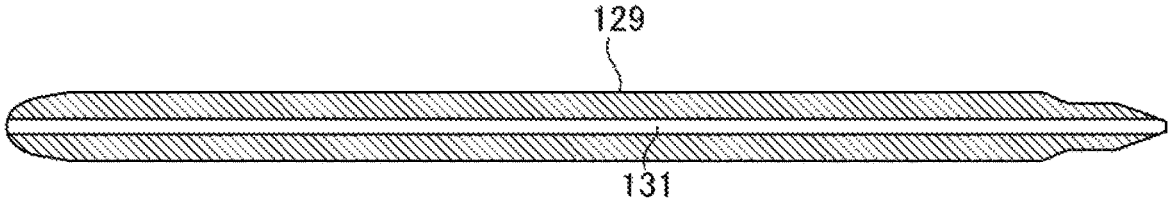
FIG. 7 is a cross-sectional view showing a modified example of a central core.

FIG. 7 is a cross-sectional view showing a modified example of the central core. As shown in FIG. 7, the central core 129 according to the modified example has a core rod 131 which is made of resin and extends coaxially with the axis of the fibrous central core 129. The core rod 131 has a circular cross section, and extends from the ink storage part to the front end of the central core 129 while penetrating the central core 129. In addition, the ink in the ink storage part passes through the inside of the central core 129, and flows to the front end of the central core 129 from the ink storage part. The central core 129 may be a porous body such as a heat-sealed core or a sintered core. In addition, the core rod 131 may be a rod in which a flow channel is formed, such as a fiber core or an extrusion-molded core that is harder than the central core 129. In addition, the cross-sectional shape of the core rod 131 may be an irregular shape such as a star shape. Furthermore, it is also acceptable that the central core 129 does not have a core rod and is a porous body such as an ordinary fiber core, a heat-sealed core or a sintered core.

Figure 8:
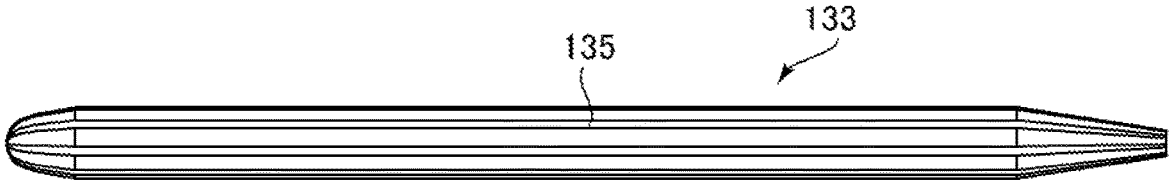
FIG. 8 is a cross-sectional view showing a further modified example of the central core.

FIG. 8 is a cross-sectional view showing a further modified example of the central core. As is shown in FIG. 8, the central core 133 according to the modified example has a plurality of passages 135 formed on its circumference. The plurality of passages 135 extend from the rear end toward the front end of the central core 133, in the circumference of the central core 133. In addition, the plurality of passages 135 are arranged at equal distances in the circumferential direction. In addition, the ink in the ink storage part flows to the front end of the central core 133 from the ink storage part, through the plurality of passages 135.

Figure 9:
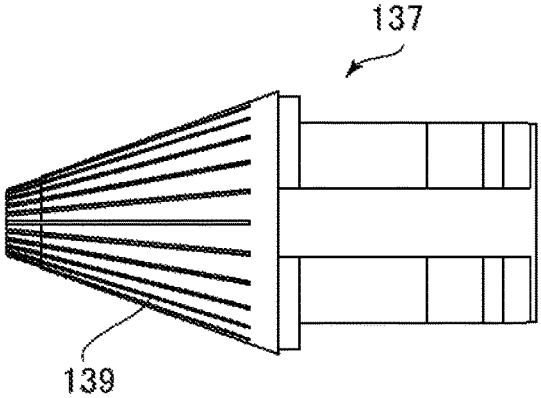
FIG. 9 is a perspective view showing a modified example of the outer member.

FIG. 9 is a perspective view showing a modified example of the outer member. As is shown in FIG. 9, a plurality of grooves 139 are formed on an outer surface of a conical shape in the front side of the outer member 137. The grooves extend along the longitudinal direction of the outer member 137, and are arranged at equal distances in the circumferential direction. Due to the capillary force of the plurality of grooves 139, the ink permeates through the grooves 139, and thereby it becomes possible for the user to write a drawn line having a wider width.

Figure 10:
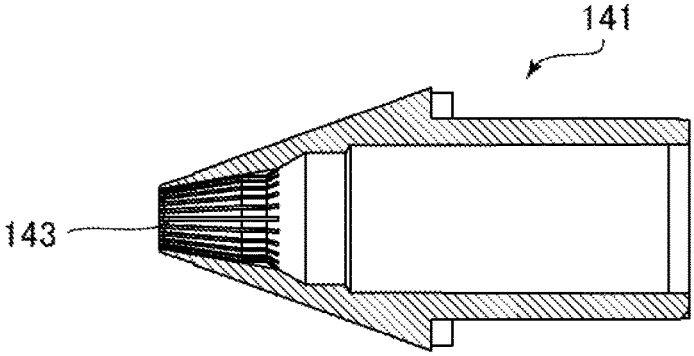
FIG. 10 is a cross-sectional view showing a further modified example of the outer member.

In addition, FIG. 10 is a cross-sectional view showing a further modified example of the outer member. As is shown in FIG. 10, the outer member 141 has a plurality of grooves 143 formed in the front insertion hole on its front side. The plurality of grooves 143 extend in the longitudinal direction along the inner surface of the front insertion hole of the outer member 141, and are arranged at equal distances in the circumferential direction. Due to the capillary force of the plurality of grooves 143, the ink permeates into the grooves 143, the liquid is always retained also in the writing part, and thereby the ink resists intermitting at the time of writing. Incidentally, the outer member may have both of the grooves 139 shown in FIG. 9 and the grooves 143 shown in FIG. 10.

Figure 11:
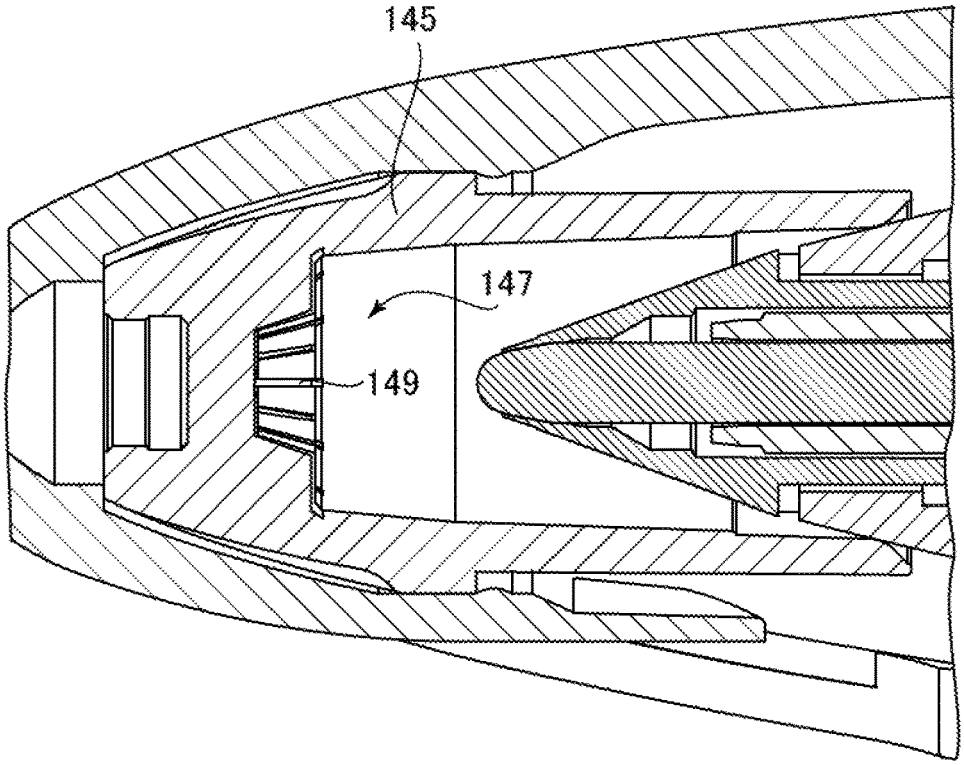
FIG. 11 is a side sectional view showing a modified example of an inner cap.

In addition, FIG. 11 is a side sectional view showing a modified example of the cap. As is shown in FIG. 11, an ink retaining portion 147 is provided inside the inner cap 145. The ink retaining portion 147 is composed of a plurality of grooves 149 which are formed at a position facing a pen tip in the inner cap 145 and extend radially from the axis of the pen. Due to the plurality of grooves 149 being formed at the position facing the pen tip, even if the ink leaks from the pen tip because of falling or the like in such a state that the cap is closed, the writing instrument can retain the ink by the grooves 149.

Figure 12:
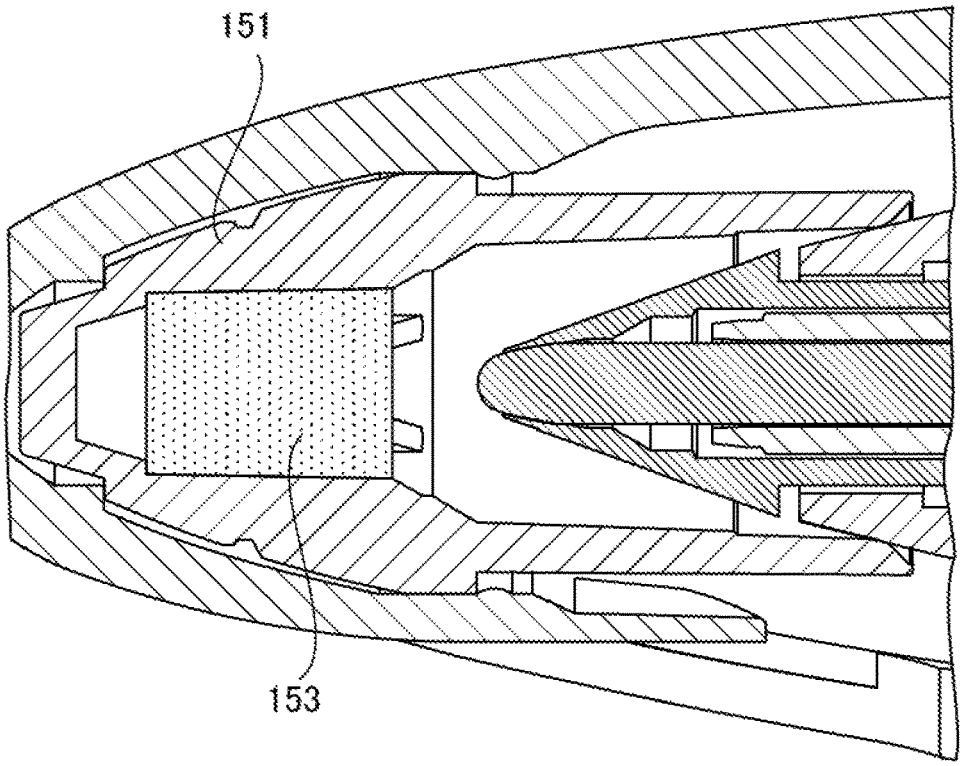
FIG. 12 is a side sectional view showing a modified example of an ink retaining portion.

In addition, FIG. 12 is a side sectional view showing a modified example of the ink retaining portion. As is shown in FIG. 12, an ink absorbing portion 153 which is formed of a porous body such as a fiber core, a sponge, a heat-sealed core and a sintered body etc. is formed inside the inner cap 151. The ink absorbing portion 153 is fixed in the inner cap 151 so as to be arranged at a position facing the pen tip when the cap is closed. Also by having the ink absorbing portion 153 made of such a porous body provided therein, the writing instrument can prevent the leakage of the ink.

Hereinafter, examples based on the embodiments of the present invention will be described in detail.

Example 1

A writing instrument having the following structure was prepared.

[Central core] external diameter: 1.2 mm, material: polyacetal

[Collector core] external diameter: 1.4 mm, material: polyethylene terephthalate

[Outer member] material: polyacetal

[Ink] aqueous pigment ink (pigment concentration of 11.5%)

- Viscosity: 2.6 mPa·s (ELD type viscosimeter under conditions of number of revolutions of 50 rpm and temperature of 25° C., made by Tokimec Co., Ltd.)
- Surface tension of 42.5 mN/m (Surface tensiometer CBVP-Z: made by Kyowa Interface Science Co., Ltd.)
- Average particle size of 90 nm (N4 PLUS: made by Beckman Coulter, Inc.)

[Others] Projection dimension of central core: 0.3 mm, and cushioning force: 1 N Lines of 1 m each were alternately drawn with the use of the above described writing instrument, under writing conditions (first writing condition) of a writing speed of 4.2 m/min, a writing angle of 65 degrees and a writing weight of 50 g, and writing conditions (second writing condition) of the writing speed of 4.2 m/min, the writing angle of 65 degrees and a writing weight of 200 g; and lines in total of 9 m were drawn. Then, the rate of change between the widths of the drawn lines was calculated. The rate of change between the widths was calculated on the basis of the width of the line according to the second writing condition/the width of the line according to the first writing condition.

Then, the rate of change between the line widths by the writing instrument according to the example was 4 to 5.8%.

Comparative Example 1

As for Comparative Example 1, lines were drawn with the use of a felt-tip pen MYT-7 made by Mitsubishi Pencil Co., Ltd., under the same conditions. At this time, the rate of change between the widths was 34.4 to 56.4%.

Example 2

With the use of the writing instrument used in Example 1, lines were drawn under writing conditions (third writing condition) of the writing weight of 50 g and a writing angle of 80 degrees, and writing conditions (fourth writing condition) of the writing weight of 200 g and a writing angle of 65 degrees, respectively; and a ratio between the widths of both of the lines was calculated. The ratio between the widths of both of the lines was calculated on the basis of the width of the line according to the fourth writing condition/the width of the line according to the third writing condition. Then, the ratio between the respective widths of the lines by the writing instrument according to the example was 2.19.

Comparative Example 2

As for Comparative Example 2, lines were drawn with the use of a felt-tip pen Pin 05-200 (8) made by Mitsubishi Pencil Co., Ltd., under the same conditions. At this time, the ratio between the widths of the lines was 1.34.

Example 3

The writing instrument used in Example 1 was prepared, and was fixed so that the pen tip faced upward, with the use of an automatic load tester MAX series made by Japan Instrumentation System Co., Ltd. Then, a load of 5 N was applied to the fixed writing instrument, at 1 mm/sec. Then, the amount of collapse of the central core of the pen tip was measured with the use of a measuring microscope MM-400 made by NIKON Corporation. The amount of the collapse was measured on the basis of the amount of change between the central cores before and after loading. As a result, the amount of the collapse of the pen tip according to the Example was 0.01 mm.

Comparative Example 3

As for Comparative Example 3, a load was applied with the use of the felt-tip pen MYT-7 made by Mitsubishi Pencil Co., Ltd., under the same conditions. At this time, the amount of the collapse was 0.15 mm.

Example 4

The writing instrument used in Example 1 was prepared, and was fixed so that the pen tip faced upward, with the use of an automatic load tester MAX series made by Japan Instrumentation System Co., Ltd. At this time, the angle of the pen with respect to the pressed surface was 60 degrees. In addition, a load of 20 N was applied at a speed of 1 mm/sec. Then, the amount of the bend of the pen tip was measured with the use of a measuring microscope MM-400 made by NIKON Corporation. The amount of the bend was obtained by measuring the distance from the tip of the pen tip to the central axis after the load was applied. As a result, the amount of the bend of the pen tip according to the example was 0.02 mm.

Comparative Example 4

As for Comparative Example 4, a load was applied with the use of the felt-tip pen Pin 05-200 (S) made by Mitsubishi Pencil Co. Ltd., under the same conditions. At this time, the amount of the bend was 0.56 mm.

Example 5

The writing instrument used in Example 1 was prepared, and a writing test in accordance with JIS 6037 was carried out under writing conditions of a writing weight of 50 g, a writing speed of 4.2 m/min and a writing angle of 65 degrees. As a result, the abrasion loss of the pen tip was 0.05 mm.

Comparative Example 5

As for Comparative Example 5, a load was applied with the use of the felt-tip pen MYT-7 made by Mitsubishi Pencil Co., Ltd., under the same conditions. At this time, the abrasion loss of the pen tip was 0.34 mm.

Example 6

The writing instrument used in Example 1 was prepared, and lines were drawn under writing conditions of the writing angle of 65 degrees, the writing weight of 50 g and the writing speed of 4.2 m/min; and the writing flow rate per unit area was calculated from flow rate and the width of the line after writing. As a result, the writing flow rate was 5.99 to 6.55 g/m$^2$.

Comparative Example 6

As for Comparative Example 6, lines were drawn with the use of the felt-tip pen MYT-7 made by Mitsubishi Pencil Co., Ltd., under the same conditions. At this time, the writing flow rate was 3.46 to 4.26 g/m$^2$.

REFERENCE SIGNS LIST

1 Felt-tip pen
11 Ink storage part
17 Collector
29 Central core

The invention claimed is:

1. A writing instrument comprising:

an ink storage part which stores ink;

an air replacement mechanism which sends the stored ink from the ink storage part by sending air into the ink storage part; and a central core which sucks the ink sent out by the air replacement mechanism with a capillary force, sends the sucked ink from a tip located in the central core, and makes the sucked ink adhere to a paper surface, wherein a rate of change is 10% or smaller between widths of lines before writing and after writing at the time when the lines are written alternately and repeatedly with a writing weight of 50 g and a writing weight of 200 g.

2. The writing instrument according to claim 1, wherein a ratio of a width of a line drawn on writing conditions of the writing angle of 60 degrees and the writing weight of 200 g, to a width of a line drawn on writing conditions of the writing angle of 90 degrees and the writing weight of 50 g is 1.5 or more.

3. The writing instrument according to claim 1, wherein an elastic limit point of a writing part including the central core is 7.0 N or more.

4. The writing instrument according to claim 1, wherein a buckling strength of the writing part including the central core is 7.0 N or more.

5. The writing instrument according to claim 1, wherein an abrasion loss of the central core at the time when a line of 100 m long has been drawn is 0.3 mm or less.

6. The writing instrument according to claim 1, wherein a writing flow rate per unit area is 5 g/m2 or more.

7. The writing instrument according to claim 1, wherein a cushioning force applied to the writing part when the writing part including the central core starts to relatively retract relative to a shaft tube due to pressurization is 0.1 N or more and 7 N or less.

* * * * *